US009368922B2

(12) United States Patent
Yen et al.

(10) Patent No.: US 9,368,922 B2
(45) Date of Patent: Jun. 14, 2016

(54) CONNECTOR

(71) Applicant: Chant Sincere Co., Ltd., New Taipei (TW)

(72) Inventors: Ming Hui Yen, New Taipei (TW); Chun Chi Chou, New Taipei (TW)

(73) Assignee: CHANT SINCERE CO., LTD., New Taipei (TW)

( * ) Notice: Subject to any disclaimer, the term of this patent is extended or adjusted under 35 U.S.C. 154(b) by 0 days.

(21) Appl. No.: 14/614,658

(22) Filed: Feb. 5, 2015

(65) Prior Publication Data

US 2015/0255931 A1 Sep. 10, 2015

(30) Foreign Application Priority Data

Mar. 7, 2014 (TW) ..... 103203972 U

(51) Int. Cl.

| | |
|---|---|
| ***H01R 13/648*** | (2006.01) |
| ***H01R 13/66*** | (2006.01) |
| ***H01R 13/6582*** | (2011.01) |
| *H01R 24/64* | (2011.01) |
| *H01R 107/00* | (2006.01) |

(52) U.S. Cl.

CPC ..... *H01R 13/6658* (2013.01); *H01R 13/6582* (2013.01); *H01R 24/64* (2013.01); *H01R 2107/00* (2013.01)

(58) Field of Classification Search

CPC ..... H01R 13/6587; H01R 23/6873; H01R 23/7073

USPC ..... 439/607.4, 607.35, 489

See application file for complete search history.

(56) References Cited

U.S. PATENT DOCUMENTS 8,727,811 B2 * 5/2014 Wang et al. ..... H01R 24/60 439/660

8,956,179 B2 * 2/2015 MacDougall ..... H01R 13/641 439/489

* cited by examiner

*Primary Examiner* — Phuong Dinh

(74) *Attorney, Agent, or Firm* — Bacon & Thomas, PLLC

(57) ABSTRACT

A connector includes a base having a top portion, a front portion, a back portion and two side portions, a terminal set disposed at the base and exposed from the top portion, a detecting assembly disposed at the base and a casing having a main body, an extension portion, two lateral portions and two first soldering legs. At least a part of the base, the terminal set and the detecting assembly are surrounded by the main body. The extension portion is extended from the main body above the top portion and folded towards the front portion to cover a part of the main body. The two lateral portions are connected to two sides of the extension portion and folded towards two sides of the base. The first soldering legs are connected to the lateral portions and extended away from the top portion. The main body and the extension portion have resilient portions and second resilient portions.

10 Claims, 4 Drawing Sheets

CONNECTOR

CROSS-REFERENCE TO RELATED APPLICATIONS

This application claims the benefit of the filing date under 35 U.S.C. §119(a)-(d) of Taiwan Patent Applications No. 103203972, filed Mar. 7, 2014.

BACKGROUND OF THE INVENTION

1. Field of the Invention

The present invention is related to a connector, and more particularly to a connector applied to universal serial bus.

2. Description of the Related Art

A connector is used for connecting a cable and an electronic device for processing a signal communication. In the existing technology, a connector following a universal serial bus connector specification is well-known, in which a universal serial bus 3.1, i.e., USB 3.1, is a kind of universal serial bus specification developed from USB 3.0, with the advantage of a high transmission speed reaching over 10G bps and supporting a high power recharging. A USB 3.1 connector is further provided with a detecting terminal for detecting whether a high power recharging is in process on a basis of a USB 3.0 connector framework. Therefore, it is an issue to provide a mechanical structure of USB 3.1 connector.

SUMMARY OF THE INVENTION

The present invention provides a connector which is applicable to the USB 3.1 connector mechanical structure.

The present invention provides a connector includes a base having a top portion, a front portion, a back portion and two side portions, a terminal set disposed at the base and exposed from the top portion, a detecting assembly disposed at the base and a casing having a main body, an extension portion, two lateral portions and two first soldering legs. At least a part of the base, the terminal set and the detecting assembly are surrounded by the main body. The extension portion is extended from the main body above the top portion and folded towards the front portion to cover a part of the main body. The two lateral portions are connected to two sides of the extension portion and folded towards two sides of the base. The first soldering legs are connected to the lateral portions and extended away from the top portion. The main body and the extension portion have resilient portions and second resilient portions.

In one embodiment of the present invention, said detecting element includes two detecting terminals and a connecting wall connecting the two detecting terminals. The two detecting terminals are located on the both sides of the set of transmission terminals. The connecting wall is near the rear portion.

In one embodiment of the present invention, said main body opens up an opening near the front portion. And, at least, the distance between part of these first resilient portions and the opening is smaller than the distance between the two detecting terminals and the opening.

In one embodiment of the present invention, the distance between said two detecting terminals and the opening is smaller than the distance between the set of transmission terminals and the opening.

In one embodiment of the present invention, the projections of the said first resilient portions do not overlap with those of the second resilient portions on the top portion.

In one embodiment of the present invention, the number of the said first resilient portions is three, and the number of the second resilient portions is two.

In one embodiment of the present invention, said casing does not cover on the rear portion of the base.

In one embodiment of the present invention, each said lateral portions include third resilient portions.

In one embodiment of the present invention, said casing further includes a plurality of second soldering legs. These second soldering legs are extended from the main body on the top portion and bend toward the two sides of the base and then extend away from the top portion direction.

In one embodiment of the present invention, the said detecting element further includes a plurality of third soldering legs. These third soldering legs are extended from the connecting wall to the direction away from the top portion.

In the present invention, the casing of the connector is provided with the extension portion and the main body, wherein the extension portion is folded backward to cover the main body such that the resilient portions can be distributed across the main body and the extension portion in such a manner that a better structural strength among these resilient portions can be achieved. Moreover, the first soldering legs of the casing extend in a direction opposite to the top portion from lateral portions which are bent from the top portion to two sides. In addition, the connecting wall of the detecting element is for connecting the two detecting terminals in such a manner that the assembly becomes easy and the rear side of the connecting wall is with effect of electromagnetic shielding.

DETAILED DESCRIPTION OF THE EMBODIMENT(S)

Figure 1:
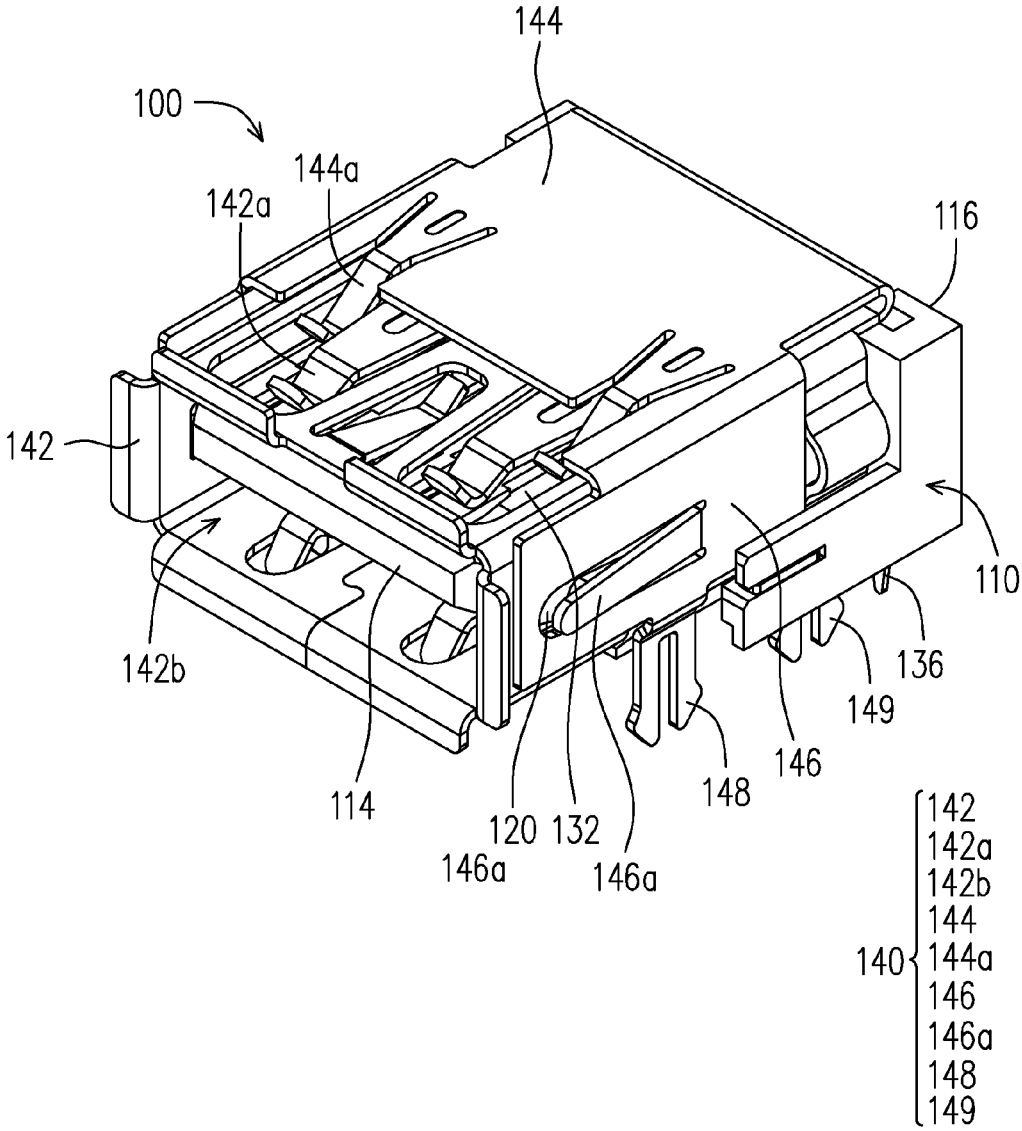
FIG. 1 is a schematic view illustrating a connector according to one embodiment of the present invention.
Figure 2:
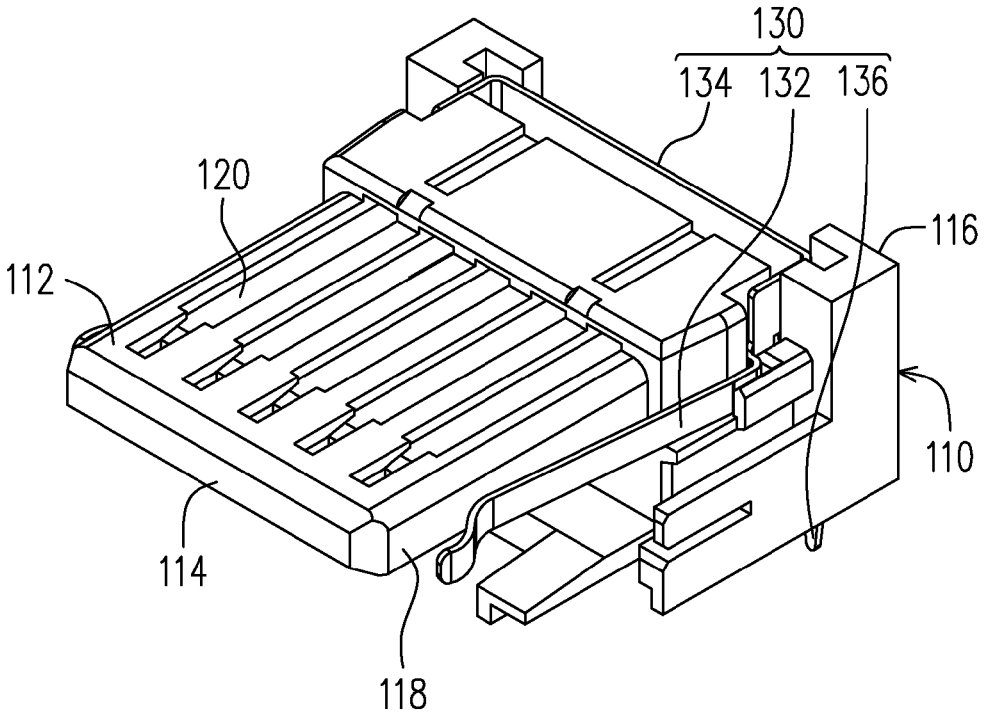
FIG. 2 is a schematic view illustrating the hidden casing of the connector of FIG. 1.

Please refer to FIGS. 1 and 2. The connector 100 is applicable to a USB 3.1 connector mechanical structure, but the kind of the connector is not limited to this. In this embodiment, the connector 100 includes a base 110, a set of transmission terminals 120, a detecting element 130 and a casing 140.

Figure 5:
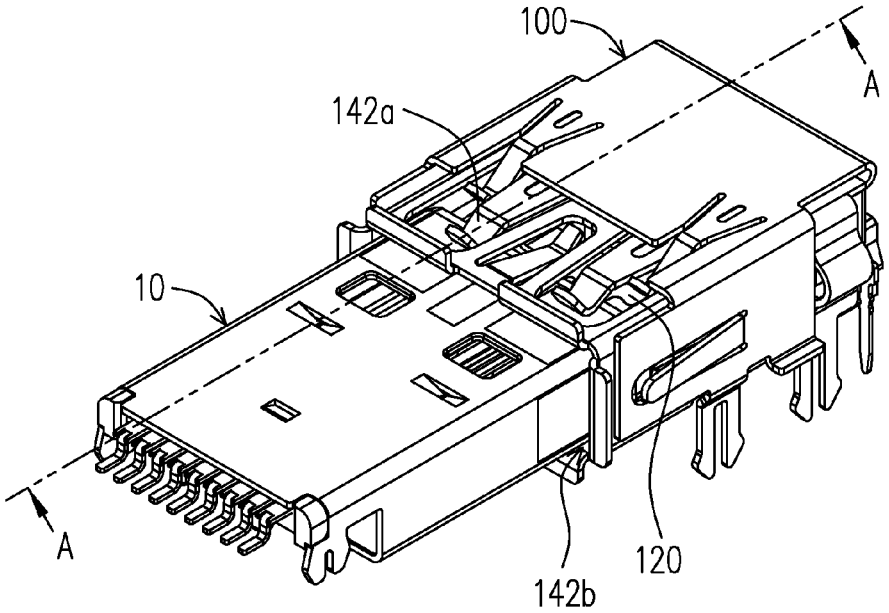
FIG. 5 is a schematic view illustrating a corresponding connector being plugged into the connector in FIG. 1.

As shown in FIG. 2, the base 110 has a top portion 112, a front portion 114 and a rear portion 116, and two side portions 118. The base 110 is made of a nonconductive material, such as plastics. The set of transmission terminals 120 is disposed on the base 110 and exposed on the top portion 112 for electrically connecting the corresponding connector 10 as shown in FIG. 5.

In FIG. 2, the number of the transmission terminals 120 is only illustrative. The real number of the terminals could be different depending on the technical specification of the connector. By taking the connector of USB 3.1 as an example, the number of terminals is 9, but the present invention is not limited to this.

Figure 3:
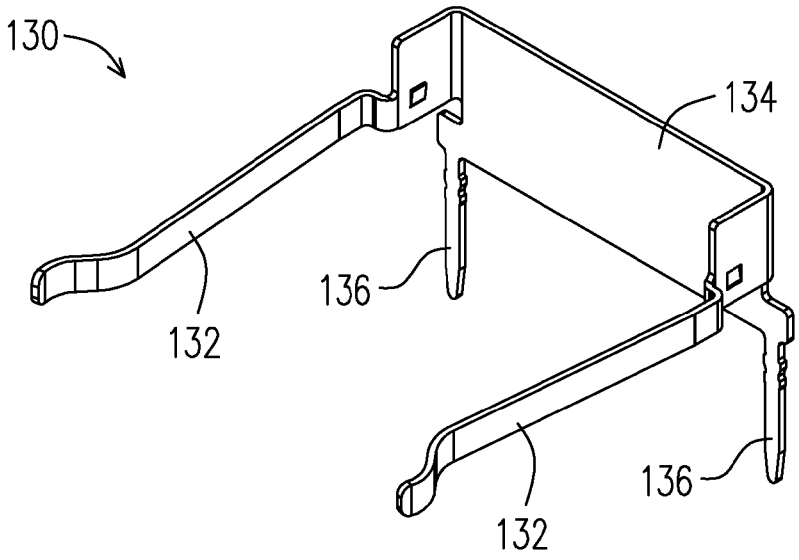
FIG. 3 is a schematic view illustrating the detecting element of the connector of FIG. 1.

FIG. 3 is a schematic view illustrating the detecting element of the connector of FIG. 1. Please refer to FIGS. 2 and 3. In this embodiment, the connector 100 includes a detecting element 130 for detecting whether a corresponding connector is plugged in to decide whether or not a procedure such as a high power recharging is to be performed. The detecting element 130 is assembled with the base 110. The detecting element 130 of the present invention includes two detecting terminals 132 and a connecting wall 134 which is for connecting the two detecting terminals. The two detecting terminals 132 are located on the both sides of the set of transmission terminals 120. The connecting wall 134 is close to the rear portion 116. The connect wall 134 of the detecting element 130 joints the two detecting terminals 132 for integrating the detecting element 130 as one piece of element and with merit of easy assembly.

In addition, since the top angle of the two detecting terminals 132 are slightly different, the corresponding connector may not able to contact the two detecting terminals 132 at the same time such that a time difference of the signal received by the two detecting terminals may exist while the corresponding connector is plugged in. To solve this problem, it may embed other wirings in a circuit board, not shown, electronically connected with the detecting terminals 132 in order to electrically connect the two detecting terminals 132. However, this scheme will change a wiring layout of the circuit board. The two detecting terminals 132 are directly connected through the connect wall 134, thereby a status of mutually connection being maintained to thus prevent from a situation of time difference between the signals received by the two detecting terminals 132. Moreover, the connecting wall 134 located on the rear portion 116 of the base 110 has the effect of electromagnetic shielding.

Figure 4:
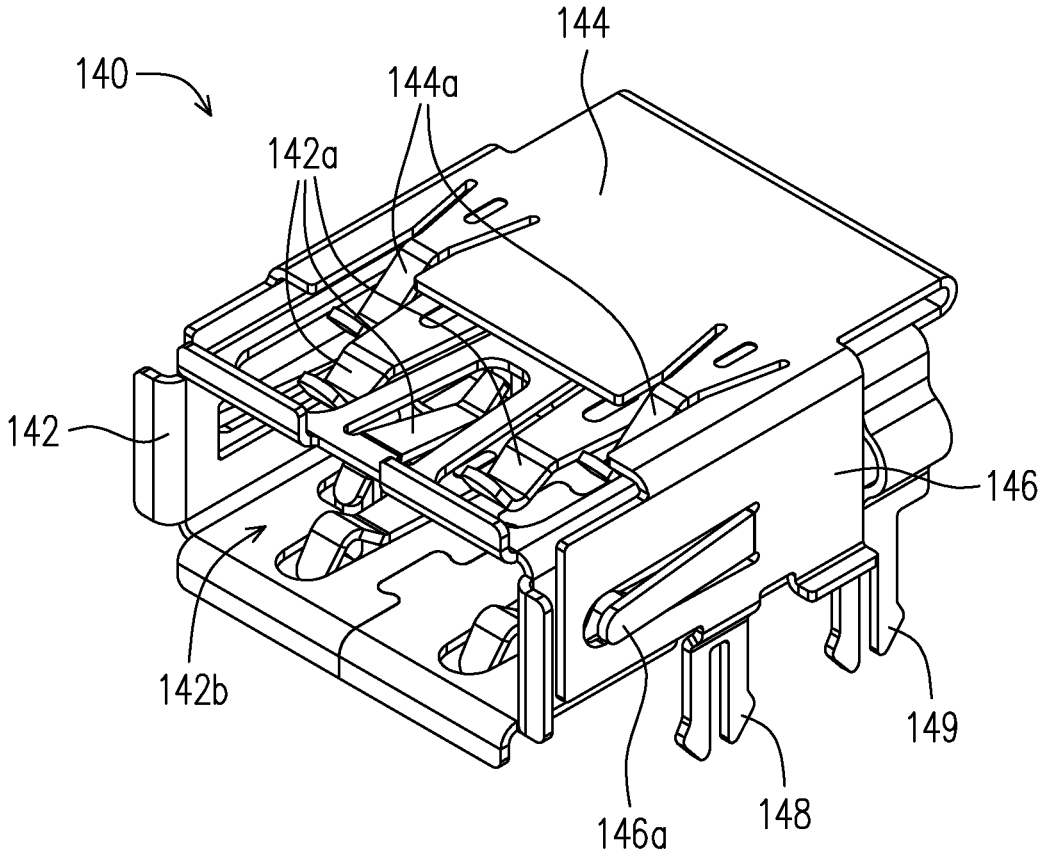
FIG. 4 is a schematic view illustrating the casing of the connector of FIG. 1.

FIG. 4 is a schematic view illustrating the casing of the connector of FIG. 1. Please refer to FIGS. 1 and 4. The casing 140 includes a main body 142, an extension portion 144, the two lateral portions 146 and two first soldering legs 148. The main body 142 is provided to surround at least a part of the base 110, the set of transmission terminals 120 and the detecting element 130. More specifically, the main body 142 of the present invention is a hollow object which is substantially surrounded by four neighboring walls, in which the set of transmission terminals 120, the detecting element 130 and the partial base 110 are disposed. An opening 142*b* is formed on a front portion 114 of the base 110 for being plugged in by the corresponding connector.

The extension portion 144 is extended from the main body 142 located above the top portion 112 and bends upwards near the rear portion 116 and then extends along the direction of the front portion 114 to cover partial main body 142 located above the top portion 112. In other words, the casing 140 exhibits a double layer structure in the area above the top portion 112 of base 110. The two lateral portions 146 connect to the both sides of the extension portion 144 and bend toward the both sides of the base 110. The two first soldering legs 148 are attached to the two lateral portions 146 separately, and are extended in the direction away from the top portion 112 to make the first soldering legs 148 connect to the circuit board that is far away from the top portion 112.

In this embodiment, because of the electromagnetic shielding effect could be achieved by the connecting wall 134 of the detecting element 130 located on the rear portion 116 of the base 110, the casing 140 does not need to fully cover the rear portion 116 of the base 110. Of course, in the other embodiments, the relative position between the casing 140 and the base 110 is not limited to this.

The main body 142 includes a plurality of first resilient portions 142*a* located above the top portion 112. The extension portion 144 includes a plurality of second resilient portions 144*a*. In this embodiment, there are three first resilient portions 142*a* and two second resilient portion 144*a*. The number of the first resilient portions 142*a* and the number of the second resilient portion 144*a* and the relative position between them are not limited to this, as long as the number of them was complied with the technical specification of the connector 100.

Generally, there will be a definition of the contact area of the corresponding connector contacted with the casing 140 of the connector 100 in the technical specification of the connector 100. The designer could refer to this area to design the position of the shrapnel on the casing 140. The casing of the connector currently available in the market has a single layer structure on above the top portion area, at which some of the resilient portions will be distributed. When there are more resilient portions needed to be distributed, and the space between the resilient portions will become smaller, hence weakening the structural strength of this portion and make it fairly easy to break. In his embodiment, the casing 140 exhibits a double layer structure formed by the main body 142 and the extension portion 144 above the top portion 112 of the base 110. Designer could distribute the resilient portions needed to be disposed in this area in the double layer structure. As a result, the spacing between each two first resilient portions 142*a* and the spacing between each two second resilient portion 144*a* can become larger, enhancing the structural strength between the resilient portions.

In this embodiment, the projections of these first resilient portions 142*a* do not overlap with those of the second resilient portions 144*a* on the top portion 112, and this makes the first resilient portions 142*a* and the second resilient portions 144*a* not to interfere with each other. Additionally, in this embodiment, compared to the first resilient portion 142*a*, the second resilient portion 144*a* have longer distance away from the opening position, making the contact parts of the staggered first resilient portion 142*a* and second resilient portion 144*a* with a corresponding connector, that is, the bending places, situated on the same plane.

Moreover, in this embodiment, as shown in FIG. 1, each lateral portion 146 includes a third resilient portion 146*a*. The casing 140 further includes a plurality of second soldering legs 149, which are extended from the body 142 situated above the top portion 112. The second soldering legs 149 bend toward the both sides of the base 110 and extend in the direction away from the top portion 112. As shown in FIG. 3, the detecting element 130 further includes several third welding legs 136 which are extended from the connecting wall 134 to the top portion 112.

Figure 6:
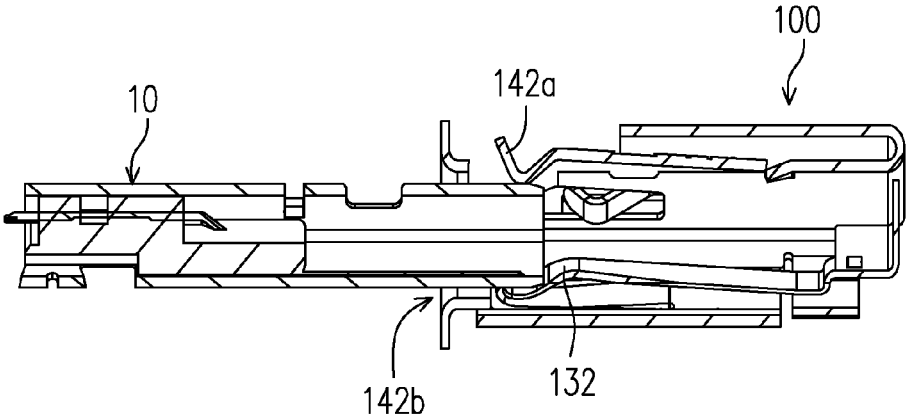
FIG. 6 is a schematic view illustrating an A-A sectional view of FIG. 5.

FIG. 5 is a schematic view illustrating a corresponding connector being plugged into the connector in FIG. 1. FIG. 6 is a schematic view illustrating an A-A sectional view of FIG. 5. Please refer to FIGS. 2, 5 and 6. As shown in FIG. 6, the distance between some of the first resilient portions 142*a* and the opening 142*b* is smaller than the distance between the two detecting terminals 132 and the opening 142*b*. And in this embodiment, as shown in FIG. 2, to make the distance between the two detecting terminals 132 and the opening 142*b* smaller than the distance between the transmission terminals 120 and the opening 142*b*, the detecting terminals 132 are located closer to the front portion 114 of the base 110 than the transmission terminals 120. That is to say, when a corresponding connector is plugged into the connector 100 of this embodiment, the corresponding connector will first contact the first resilient portions 142*a*, and then contact the detecting terminals 132, and finally, contact the transmission terminals 120. The distance between all the components of the connector 100 and the opening 142*b* could vary according to the order of contact between the components and the corresponding connector 10 in the technical specification of connectors, and is not limited to this.

In summary, the casing of the connector in the present invention goes through the extension portion and is folded backward to the main body to enable the resilient portions to be distributed on top of the main body and the extension portion, thus making the resilient portions have better structural strength. Moreover, the first welding legs of the casing connect to the two lateral portions that are extended from the top portion and bend toward the both sides, extending in the direction away from the top portion. In addition, the connecting wall of the detecting element connects the two detecting terminals in such a manner that the assembly becomes easier and the connecting wall near the rear portion is with the advantage of electromagnetic shielding effect.

While the invention has been described in terms of various specific embodiments, those skilled in the art will recognize that the invention can be practiced with modification within the spirit and scope of the claims.

What is claimed is:

1. A connector, comprising:

a base having a top portion, a front portion, a rear portion and two side portions;

a set of terminals disposed at said base and exposed from said top portion;

a detecting assembly disposed at said base; and a casing having a main body, an extension portion, two lateral portions and two first soldering legs, at least a part of said base, said terminal set and said detecting assembly are surrounded by said main body; said extension portion is extended from said main body above said top portion and folded towards the front portion to cover a part of said main body; said two lateral portions are connected to two sides of said extension portion and folded towards two sides of said base; the first soldering legs are connected to said lateral portions and extended away from said top portion, said main body and said extension portion have first resilient portions and second resilient portions.

2. The connector of claim 1, wherein said detecting element includes two detecting terminals and a connecting wall connecting said two detecting terminals, which are located on the both sides of said set of transmission terminals, said connecting wall is near the rear portion.

3. The connector of claim 2, wherein said main body opens up an opening near said front portion, the distance between part of these first resilient portions and said opening is smaller than the distance between said two detecting terminals and said opening.

4. The connector of claim 3, wherein the distance between said two detecting terminals and said opening is smaller than the distance between said set of transmission terminals and said opening.

5. The connector of claim 1, wherein said projections of the said first resilient portions overlap no with those of the second resilient portions on said top portion.

6. The connector of claim 1, wherein the number of the said first resilient portions is three, and the number of the second resilient portions is two.

7. The connector of claim 1, wherein said casing cover no rear portion of said base.

8. The connector of claim 1, wherein said each the said lateral portions include a third resilient portions.

9. The connector of claim 1, wherein said casing further includes a plurality of second soldering legs, which are extended from the main body on said top portion and bend toward said two sides of said base and then extend away from said top portion direction.

10. The connector of claim 1, wherein said detecting element further includes a plurality of third soldering legs, which are extended from said connecting wall to the direction away from said top portion.

* * * * *